US006905420B2

(12) United States Patent
Tang et al.

(10) Patent No.: US 6,905,420 B2
(45) Date of Patent: Jun. 14, 2005

(54) PUTTER HEAD

(75) Inventors: Larry G. Tang, Carlsbad, CA (US); Roger Cleveland, Los Angeles, CA (US); Richard C. Helmstetter, Rancho Santa Fe, CA (US); Augustin W. Rollinson, Carlsbad, CA (US); Wayne H. Byrne, Murrieta, CA (US); Luke R. Williams, La Jolla, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/711,332

(22) Filed: Sep. 10, 2004

(65) Prior Publication Data

US 2005/0014575 A1 Jan. 20, 2005

Related U.S. Application Data

(60) Continuation of application No. 10/707,847, filed on Jan. 16, 2004, now Pat. No. 6,793,588, which is a continuation of application No. 10/065,232, filed on Sep. 26, 2002, now Pat. No. 6,679,782, which is a continuation-in-part of application No. 10/063,908, filed on May 22, 2002, now Pat. No. 6,471,600, which is a continuation-in-part of application No. 09/683,125, filed on Nov. 21, 2001, now Pat. No. 6,506,125, which is a continuation-in-part of application No. 29/147,888, filed on Sep. 7, 2001, now Pat. No. Des. 458,656, which is a continuation-in-part of application No. 09/693,349, filed on Oct. 20, 2000, now Pat. No. 6,632,391, which is a division of application No. 09/389,798, filed on Sep. 3, 1999, now Pat. No. 6,238,302.

(51) Int. Cl.[7] ..... A63B 69/36; A63B 53/04

(52) U.S. Cl. ..... 473/242; 473/249; 473/251; 473/340; 473/342; 473/349

(58) Field of Search ..... 473/251–256, 473/324–350, 242, 249; D21/736–746, 759

(56) References Cited

U.S. PATENT DOCUMENTS

| | | | | | |
|---|---|---|---|---|---|
| 4,138,117 | A | * | 2/1979 | Dalton | 473/255 |
| 4,163,554 | A | * | 8/1979 | Bernhardt | 473/255 |
| 4,688,798 | A | * | 8/1987 | Pelz | 473/249 |
| 5,322,285 | A | * | 6/1994 | Turner | 473/313 |
| 6,471,600 | B2 | * | 10/2002 | Tang et al. | 473/242 |
| 6,506,125 | B2 | * | 1/2003 | Helmstetter et al. | 473/242 |
| 6,679,782 | B2 | * | 1/2004 | Tang et al. | 473/242 |
| 6,793,588 | B2 | * | 9/2004 | Tang et al. | 473/242 |

* cited by examiner

*Primary Examiner*—Sebastiano Passaniti
(74) *Attorney, Agent, or Firm*—Michael A. Catania; Elaine H. Lo

(57) ABSTRACT

A putter (100) having a club head (20) having a central aperture (32) with a rearward center of gravity is disclosed herein. The club head (20) has a body (22) that is preferably composed of stainless steel. The body (22) has a face portion (24), a crown portion (26), a sole portion (28) and an aft-mass portion (30). The face portion (24), the crown portion (26), the sole portion (28) and the aft-mass portion (30) define the central aperture (32). The crown portion (26) extends rearward from the face portion (24) over the aft-mass portion (30). The central aperture (32) separates the crown portion (26) from the sole portion (28) and the face portion (24) from the aft-mass portion (30). The crown portion (26) has an alignment means (40) thereon for aiming a golf ball during putting. The putter has novel inertial properties.

40 Claims, 12 Drawing Sheets

PUTTER HEAD

CROSS REFERENCE TO RELATED APPLICATIONS

The present application is a continuation application of U.S. patent application Ser. No. 10/707,847 filed Jan. 16, 2004 now U.S. Pat. No. 6,793,588, which is a continuation application of U.S. patent application Ser. No. 10/065,232, filed Sep. 26, 2002 now U.S. Pat. No. 6, 679,782, which is a continuation-in-part application of U.S. patent application Ser. No. 10/063,908, filed on May 22, 2002, now U.S. Pat. No. 6,471,600, which is a continuation-in-part application of U.S. patent application Ser. No. 09/683,125, filed on Nov. 21, 2001, now U.S. Pat. No. 6,506,125, which is a continuation-in-part application of U.S. patent application Ser. No. 29/147,888, filed on Sep. 7, 2001, now U.S. Pat. No. D458,656, and a continuation-in-part application of U.S. patent application Ser. No. 09/693,349, filed on Oct. 20, 2000, now U.S. Pat. No. 6,632,391, which is a divisional application of U.S. patent application Ser. No. 09/389,798, filed on Sep. 3, 1999, now U.S. Pat. No. 6,238,302.

FEDERAL RESEARCH STATEMENT

[Not Applicable]

BACKGROUND OF INVENTION

1. Field of the Invention

The present invention relates to a putter-type club head. More specifically, the present invention relates to a putter-type club head having a rearward center of gravity.

2. Description of the Related Art

The golf industry has been inventing putters that make the game of golf easier for the high handicap player. One such putter is disclosed in U.S. Pat. No. 4,688,798 to David Peiz. The Pelz patent discloses a putter with an alignment means to assist a golfer in aiming a golf ball toward a hole during putting. The Pelz patent discloses using two or three golf ball shaped indicators as the alignment means. The golf ball shaped indicators may be circles, hemispheres, or complete spheres. The Pelz patent discloses positioning the indicators along a line extending rearward from the center of percussion.

Another patent that discloses an alignment means is U.S. Pat. No. 4,659,083 to Szczepanski. The Szczepanski patent discloses a group of lines that converge toward the center of the face of the putter.

Yet another patent that discloses an alignment means is Great Britain Patent Application Number 4,659,083 to Lilley. The Lilley patent also discloses a group of lines that converge toward the center of the face of a putter.

Although these inventions have provided new and improved putters for making the game of golf more enjoyable for high handicap players, the prior art has not optimized a putter by making it more forgiving and assisting in alignment.

SUMMARY OF INVENTION

One aspect of the present invention is a putter with novel inertial properties.

Another aspect of the present invention is a putter having a club head, a shaft connected the club head, and a grip attached to shaft. The putter has a center of gravity located at least 1.5 centimeters rearward from a shaft axis of the putter.

Yet another aspect of the present invention is a putter having a club head, a shaft connected the club head, and a grip attached to shaft, and the putter has a torsion swing inertia, Ixz, that has an absolute value greater than 10,000 grams-centimeter square.

Yet another aspect of the present invention is a putter having a club head, a shaft connected the club head, and a grip attached to shaft, and the putter has a swing static imbalance, Sy, greater than 500 grams-centimeter.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
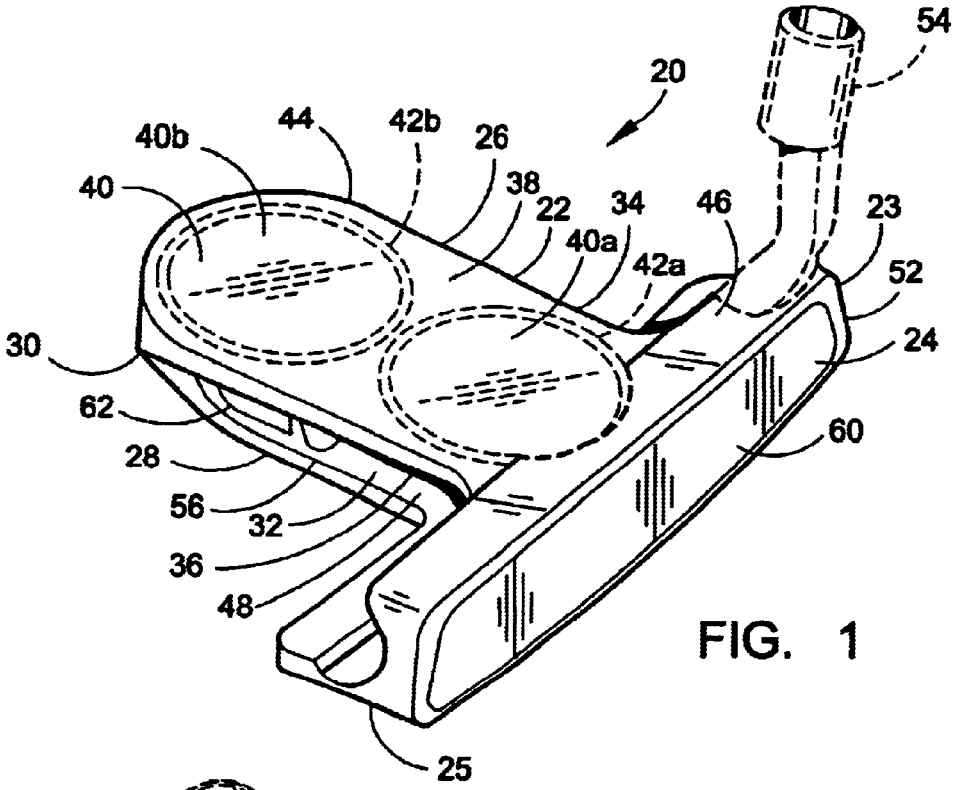
FIG. 1 is a top perspective view of a putter-type club head.

As shown in FIGS. 1–8, a putter-type club head is generally designated 20. The club head 20 has a body 22 that is preferably composed of a cast metal. A preferred metal for the body 22 is stainless steel. Alternative materials for the body 22 include titanium, titanium alloys, carbon steel, bronze, and the like. The body 22 preferably weighs from 275 grams to 400 grams, more preferably from 300 grams to 350 grams, even more preferably from 315 grams to 335 grams and most preferably 328 grams.

Figure 3:
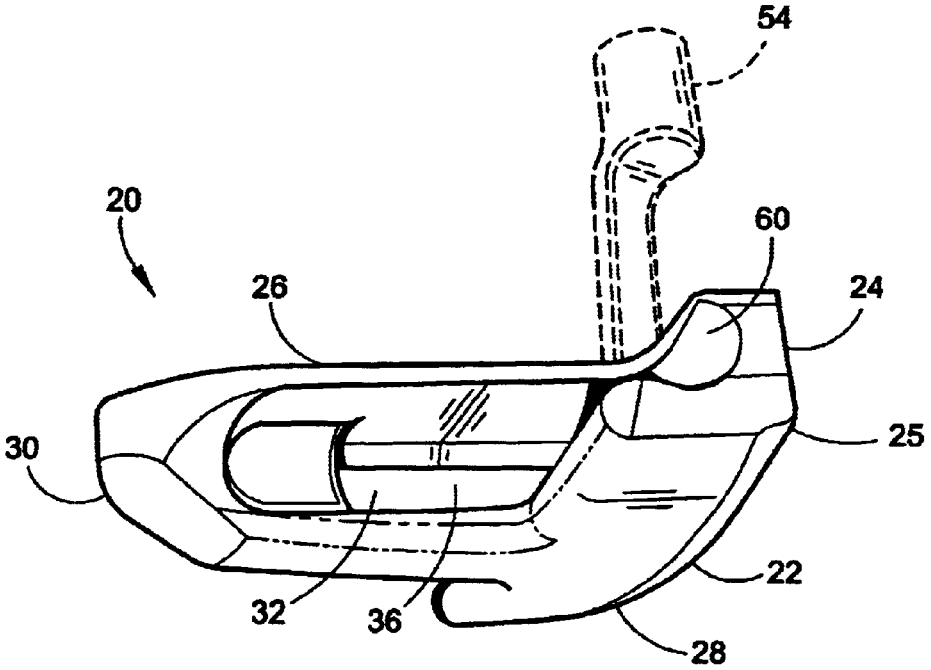
FIG. 3 is a perspective view from the bottom of the putter-type club head of FIG. 1.
Figure 4:
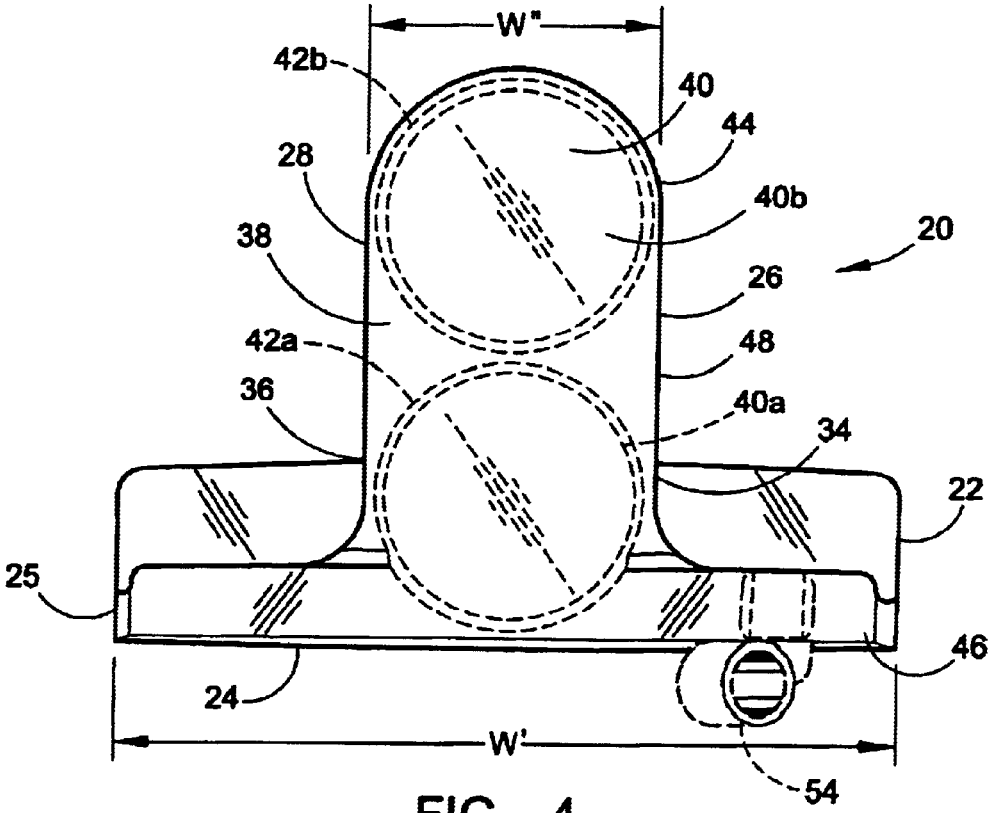
FIG. 4 is a top plan view of the putter-type club head of FIG. 1.
Figure 5:
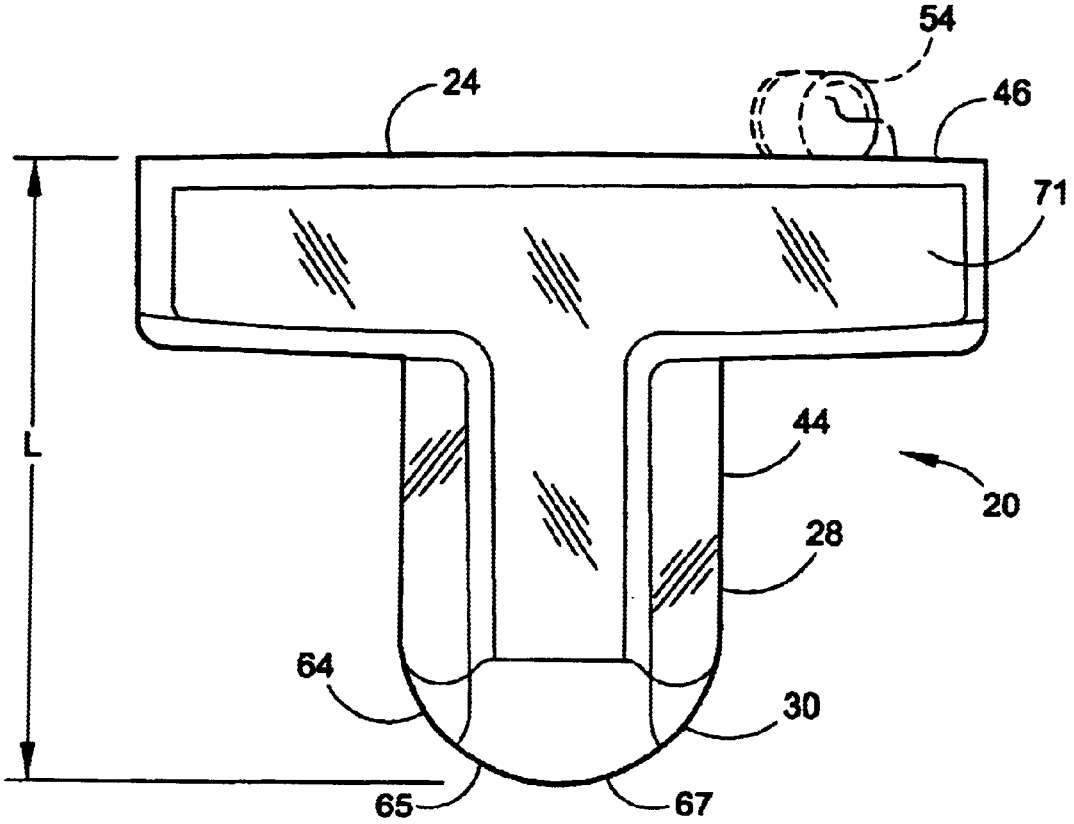
FIG. 5 is a bottom plan view of the putter-type club head of FIG. 1.
Figure 6:
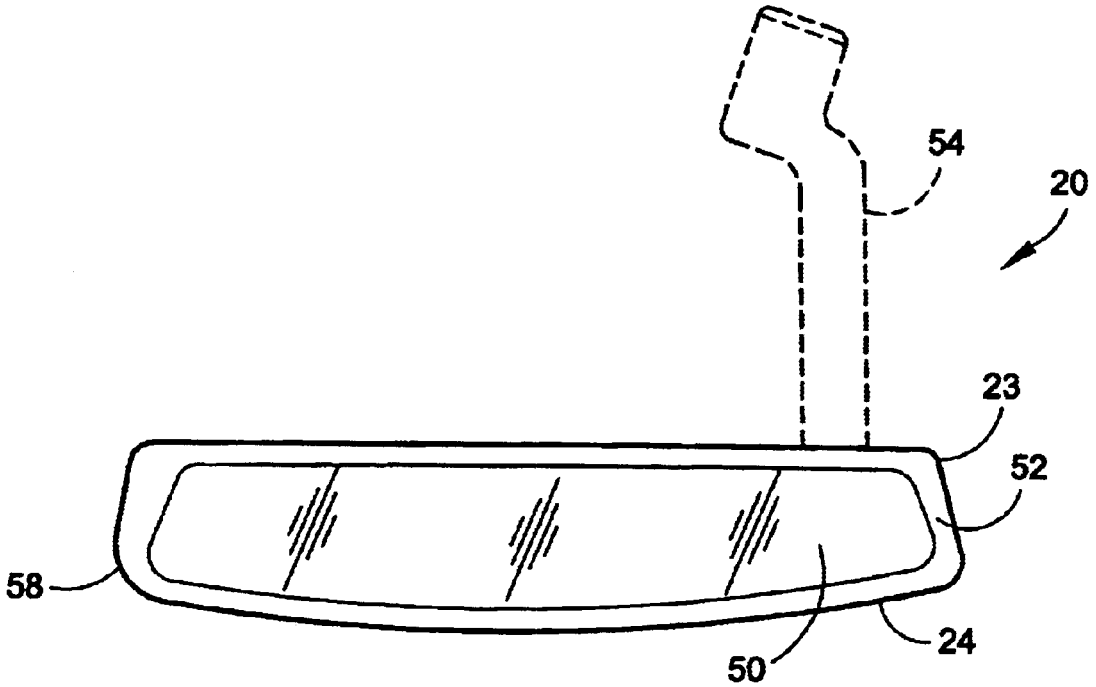
FIG. 6 is a front plan view of the putter-type club head of FIG. 1.
Figure 7:
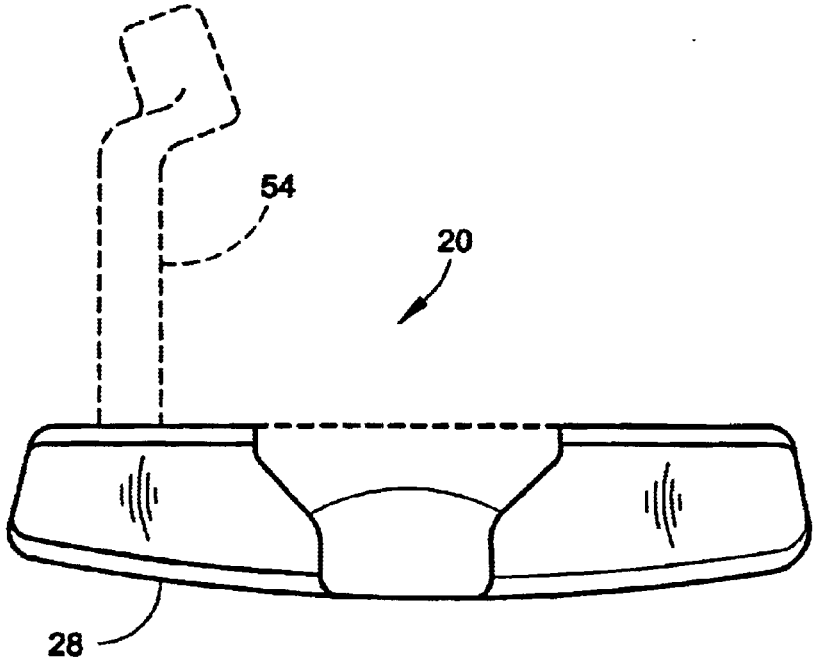
FIG. 7 is a rear plan view of the putter-type club head of FIG. 1.
Figure 9:
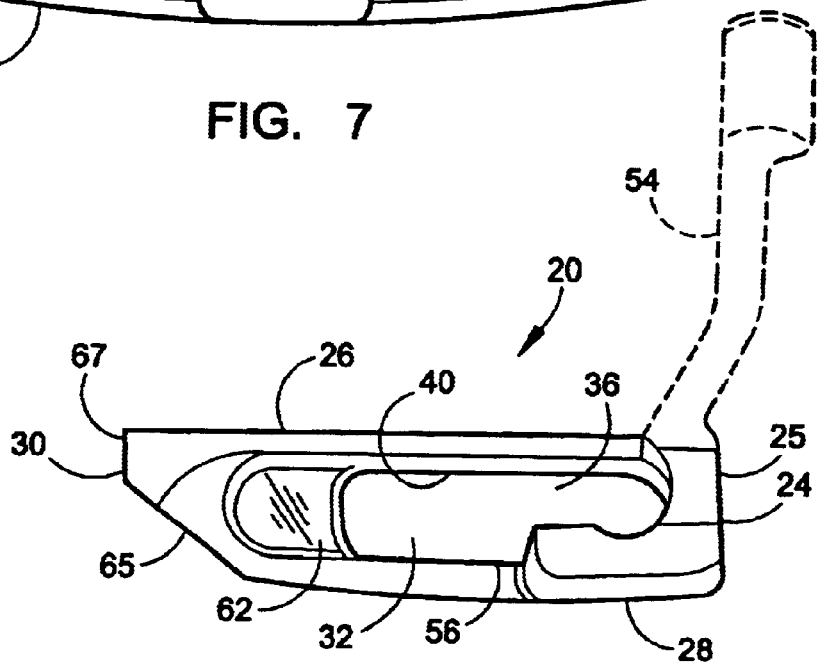
FIG. 9 is a toe side view of the putter-type club head of FIG. 1.
Figure 8:
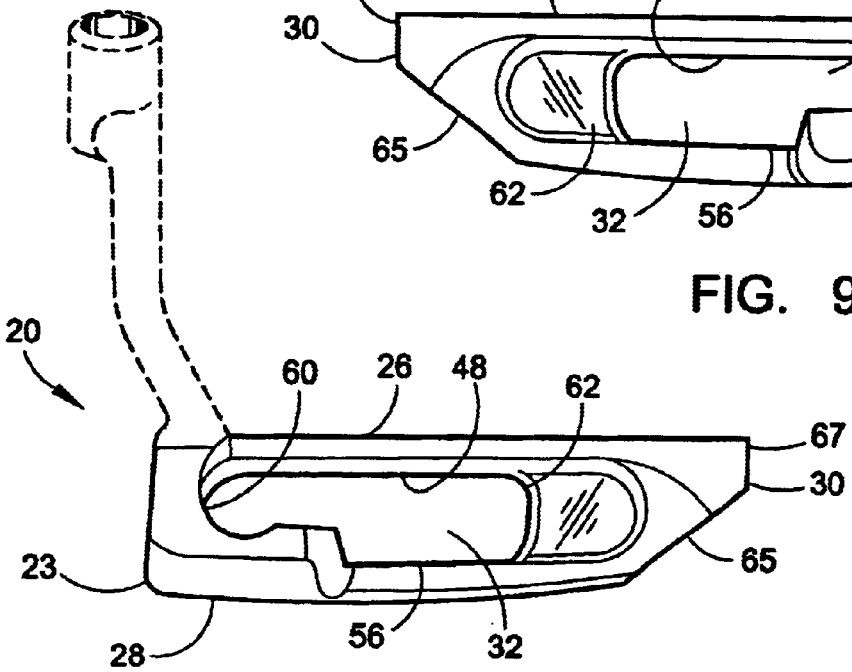
FIG. 8 is a heel side view of the putter-type club head of FIG. 1.
Figure 10:
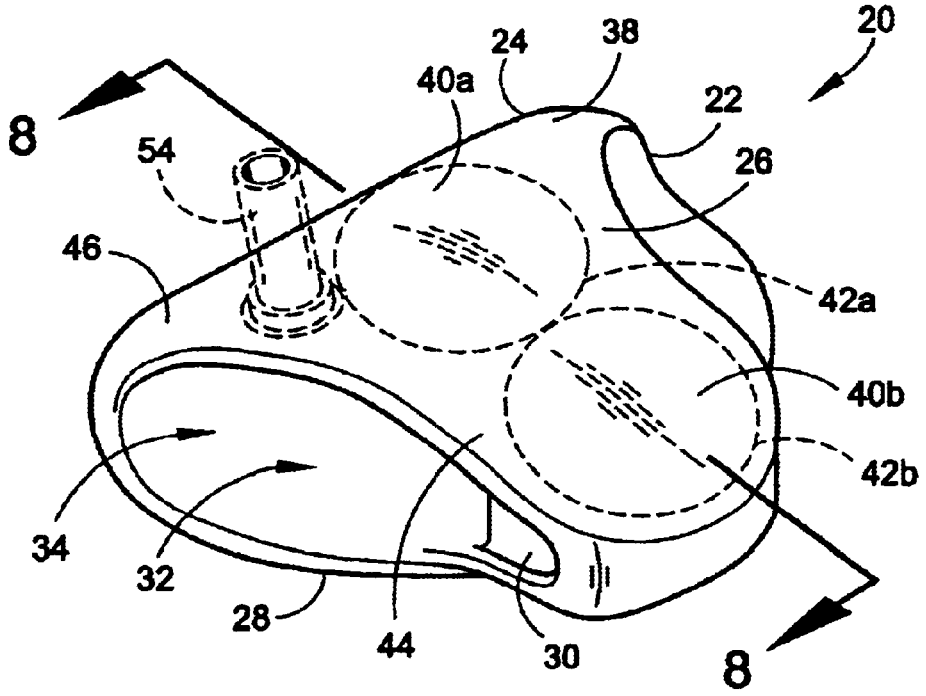
FIG. 10 is a top perspective view of an alternative embodiment of a putter-type club head.
Figure 11:
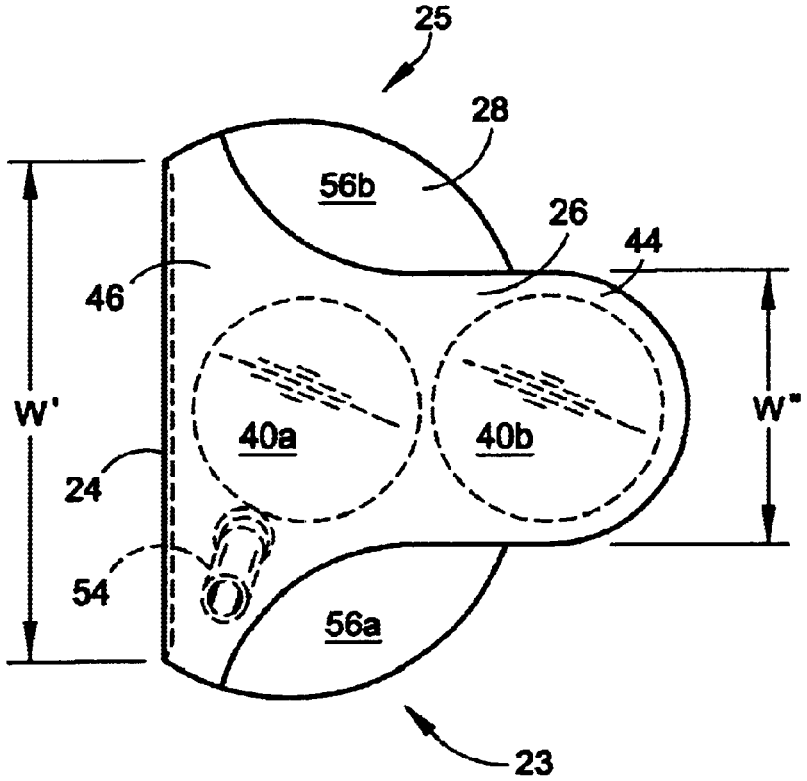
FIG. 11 is a top plan view of putter-type club head of FIG. 10.

The body 22 has a face portion 24, a crown portion 26, a sole portion 28 and an aft-mass portion 30. The face portion 24, the crown portion 26, the sole portion 28 and the aft-mass portion 30 define a central aperture 32 that extends through the body 22. The central aperture 32 has a heel opening 34 at a heel end 23 of the body 22 and a toe opening 36 at a toe end 25 of the body 22. The central aperture 32 horizontally separates the face portion 24 from the aft-mass portion 30, and the central aperture 32 vertically separates the crown portion 26 from the sole portion 28. The central aperture 32, in connection with the aft-mass portion 30, allows for the center of gravity of the club head 20, CG, to be moved rearward from the face portion 24. In a preferred embodiment, the CG of the club head 20 is positioned within the central aperture 32, and thus the CG is not positioned within material of the club head 20 but instead the CG lies outside the material in space within the central aperture 32. Preferably, the CG is located between 0.25 inch and 1.0 inch from an external surface 71 of the sole portion 28, more preferably 0.50 inch to 0.75 inch, and most preferably 0.73 inch from the external surface 71 of the sole portion 28. Also, preferably the CG of the club head 20 is located 0.50 inch to 2.5 inches rearward from the external surface 58 of the face portion 24, more preferably 0.75 inch to 1.5 inches, and most preferably 0.944 inch from the external surface 58 of the face portion 24. In addition to assisting in the rearward positioning of the CG, the aft-mass portion 30 is a rearward support structure for crown portion 26. The aft-mass portion 30 extends upward and rearward from a rearward end 29 of the sole portion 28. The aft-mass portion 30 ranges from 10 to 30 volume percent of the body 22 and ranges from 25 to 75 weight percent of the body 22. More preferably, the aft-mass portion 30 ranges from 15 to 25 volume percent of the body 22 and ranges from 40 to 60 weight percent of the body 22. The external surface 64 of the aft-mass portion 30 preferably defines an acute edge 65 (relative to the ground) and a straight edge 67 (relative to the ground). As shown in FIG. 3, the aft-mass portion 30 extends outward from the sole portion 28. An internal surface 62 of the aft-mass portion 30 defines a portion of the central aperture 32.

The sole portion 28 preferably has an approximate T-shape. The external surface 71 of the sole portion 28 contacts the ground when the club head 20 is used with a shaft and grip, both not shown, as a putter. A center section of an internal surface 56 of the sole portion 28 partially defines the central aperture. The CG of the club head 20 preferably lies above the sole portion 28.

The crown portion 26 extends rearward from the face portion 24. The crown portion 26 has a central elongated section 44 and a front section 46. The front section 46 has a width w' that extends from the heel end 23 to the toe end 25 of the face portion 24, and gradually narrows as the front section 46 transitions into the central elongated section 44. The width, w', preferably ranges from 2.5 inches to 5.0 inches, more preferably from 3.5 inches to 4.5 inches, and most preferably 4.25 inches. The central elongated section 44 has a width w" that is less than the width w' of the front section 46. The width, w", preferably ranges from 1.0 inch to 3.0 inches, more preferably from 1.5 inches to 2.25 inches, and most preferably 1.8 inches. The internal surface 48 of the crown portion 26 partially defines the central aperture 32. The crown portion preferably has a thickness that ranges from 0.10 inch to 0.50 inch, more preferably 0.15 inch to 0.30 inch.

The external surface 38 of the crown portion 26 preferably has an alignment means 40 thereon. The external surface 38 also preferably has a cylindrical rod 54 extending upward therefrom for engagement with a shaft, not shown. A preferred alignment means 40 is first and second inserts 40*a* and 40*b* disposed within first and second recesses 42*a* and 42*b* in the crown portion 26. The depth of each of the recesses 42*a* and 42*b* is preferably within 0.05 inch to 0.50 inch, more preferably 0.1 inch to 0.250 inch. Each of the circular inserts 40*a* and 40*b* preferably have a thickness ranging from 0.05 inch to 0.50 inch, more preferably 0.1 inch to 0.250 inch.

In a preferred embodiment, each of the circular inserts 40*a* and 40*b* are preferably composed of a thermosetting polyurethane material such as described in U.S. Pat. No. 6,273,831, entitled Golf Club Head with A Polymer Insert, assigned to Callaway Golf (the assignee of the Present Application), which is hereby incorporated by reference in its entirety. Alternatively, each of the circular inserts 40*a* and 40*b* may be composed of a thermoplastic polyurethane. Each of the circular inserts 40*a* and 40*b* is preferably colored white, through painting or doping of the polyurethane with coloring agents, and each circular insert 40*a* and 40*b* preferably has a texture of a golf ball cover. Each of the circular inserts 40*a* and 40*b* preferably has a diameter ranging from 1.62 inches to 1.70 inches, and most preferably 1.68 inches. Those skilled in the art will recognize that more than two circular inserts 40*a* and 40*b* may be utilized without departing from the scope and spirit of the present invention. Alternative alignment means are disclosed in U.S. Pat. No. 4,688,798, entitled Golf Club And Head Including Alignment Indicators, assigned to the Callaway Golf (the assignee of the Present Application), which pertinent parts are hereby incorporated by reference. As disclosed in U.S. Pat. No. 4,688,798, the alignment means assists a golfer in properly aiming a golf ball toward a hole when putting. Alternative alignment means, including a large white strip may be utilized in the present invention.

The face portion 24 preferably has a thickness ranging from 0.10 inch to 0.50 inch, more preferably 0.20 inch to 0.35 inch. The face portion 24 has an internal surface 60 that partially defines the central aperture 32. The external surface 58 of the face preferably has a face recess 52 therein with a face insert 50 disposed therein such as disclosed in U.S. Pat. No. 6,238,302, entitled A Golf Club Head With An Insert Having Integral Tabs, assigned to Callaway Golf (the assignee of the Present Application), which is hereby incorporated by reference in its entirety. As disclosed in U.S. Pat. No. 6,238,302, the face insert is preferably composed of a thermosetting polyurethane material and is preferably colored white. In an alternative embodiment, the face portion 24 is a non-insert blade as is known in the art.

The body 22 preferably has a length, L, from the face portion 24 to the rearward most end of the aft mass portion 30 preferably ranging from 2.5 inches to 4.5 inches, more preferably from 3.0 inches to 4.0 inches, and most preferably 3.43 inches. In one alternative embodiment, the body 22 has a length, L, that is equal to the width, w'.

As mentioned previously, the central aperture is defined by the internal surface 60 of the face portion 24, the internal surface 48 of the crown portion 26, the internal surface 56 of the sole portion 28 and the internal surface 62 of the aft-mass portion 30. The distance from the internal surface 48 of the crown portion 26 to the internal surface 56 of the sole portion 28 preferably ranges from 0.01 inch to 1.50 inches, more preferably 0.25 inch to 1.0 inch, and most preferably 0.5 inch. The distance from the internal surface 60 of the face portion 24 to the internal surface 62 of the aft-mass portion 30 preferably ranges from 1.0 inch to 3.50 inches, more preferably from 1.5 inches to 3.0 inches, and most preferably 2.00 inches. The body 22 is preferably formed as a single cast structure using known investment casting techniques. However, those skilled in the pertinent art will recognize that alternative forming techniques such as milling, welding forged or formed pieces, and the like may be utilized without departing from the scope and spirit of the present invention.

The golf club putter of the present invention may alternatively have an embodiment as shown in FIGS. 10–17, wherein a putter-type club head of the present invention is generally designated 20. The club head 20 has a body 22 that is preferably composed of a cast metal. A preferred metal for the body 22 is stainless steel. Alternative materials for the body 22 include titanium, titanium alloys, carbon steel, bronze, and the like. The body 22 preferably weighs from 275 grams to 400 grams, more preferably from 300 grams to 350 grams, even more preferably from 315 grams to 335 grams and most preferably 328 grams.

The body 22 has a face portion 24, a crown portion 26, a sole portion 28 and an aft-mass portion 30. The face portion 24, the crown portion 26, the sole portion 28 and the aft-mass portion 30 define a central aperture 32 that extends through the body 22. The central aperture 32 has a heel opening 34 at a heel end 23 of the body 22 and a toe opening 36 at a toe end 25 of the body 22. The central aperture 32 horizontally separates the face portion 24 from the aft-mass portion 30, and the central aperture 32 vertically separates the crown portion 26 from the sole portion 28. The central aperture 32, in connection with the aft-mass portion 30, allows for the center of gravity of the club head 20, CG, to be moved rearward from the face portion 24. In a preferred embodiment, the CG of the club head 20 is positioned within the central aperture 32, and thus the CG is not positioned within material of the club head 20 but instead the CG lies outside the material in space within the central aperture 32. Preferably, the CG is located between 0.25 inch and 1.0 inch from an external surface 71 of the sole portion 28, more preferably 0.50 inch to 0.75 inch, and most preferably 0.615 inch from the external surface 71 of the sole portion 28. Also, preferably the CG of the club head 20 is located 0.50 inch to 2.5 inches rearward from the external surface 58 of the face portion 24, more preferably 0.75 inch to 2.0 inches, and most preferably 1.2 inches from the external surface 58 of the face portion 24. In addition to assisting in the rearward positioning of the CG, the aft-mass portion 30 is a rearward support structure for crown portion 26. The aft-mass portion 30 extends upward and rearward from a rearward end 29 of the sole portion 28. The aft-mass portion 30 ranges from 10 to 30 volume percent of the body 22 and ranges from 25 to 75 weight percent of the body 22. More preferably, the aft-mass portion 30 ranges from 15 to 25 volume percent of the body 22 and ranges from 40 to 60 weight percent of the body 22. The external surface 64 of the aft-mass portion 30 preferably defines an acute edge 65 (relative to the ground) and a straight edge 67 (relative to the ground). As shown in FIG. 3, the aft-mass portion 30 extends outward from the sole portion 28. An internal surface 62 of the aft-mass portion 30 defines a portion of the central aperture 32.

Figure 2:
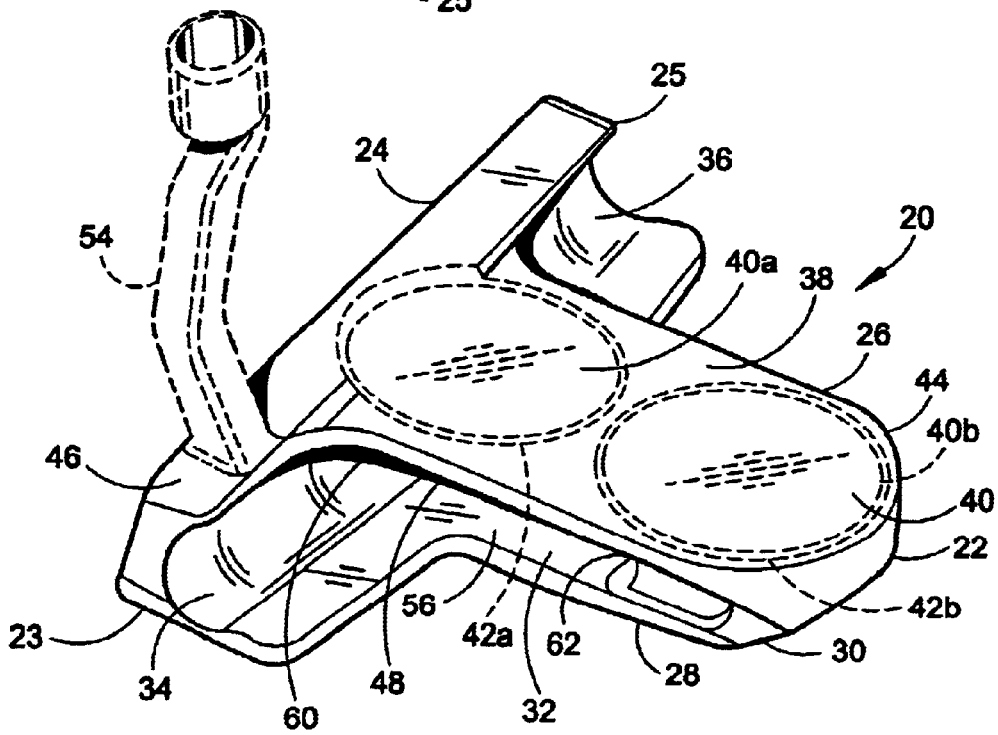
FIG. 2 is a top perspective view from the heel of the putter-type club head of FIG. 1.

The sole portion 28 preferably has an approximate semi-circular shape and is substantially planar. The external surface 71 of the sole portion 28 contacts the ground when the club head 20 is used with a shaft and grip, both not shown, as a putter. A center section of an internal surface 56 of the sole portion 28 partially defines the central aperture, and such center section of the internal surface 56 is covered by the crown portion 26. A heel section 56*a* and a toe section 56*b* of the internal surface 56 of the sole portion 28 are not covered by the crown portion, and are exposed as shown in FIG. 2. The CG of the club head 20 preferably lies above the sole portion 28.

Figure 12:
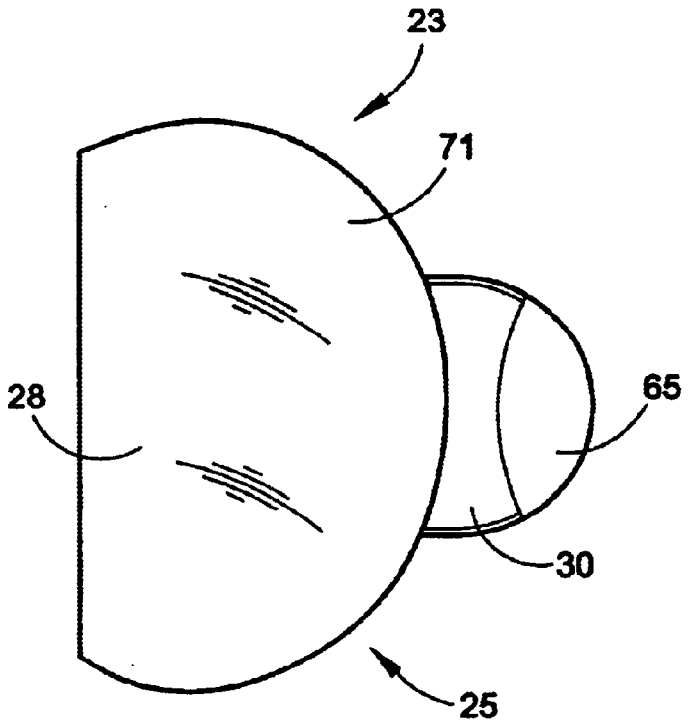
FIG. 12 is a bottom plan view of putter-type club head of FIG. 10.
Figure 12A:
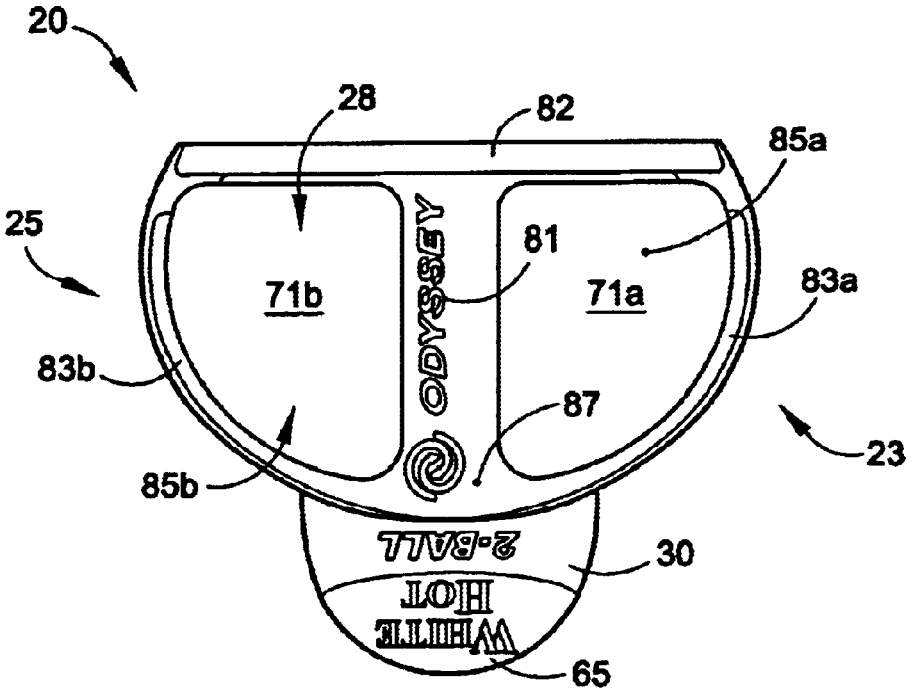
FIG. 12A is a bottom plan view of putter-type club head of FIG. 10 with an alternative sole.
Figure 13:
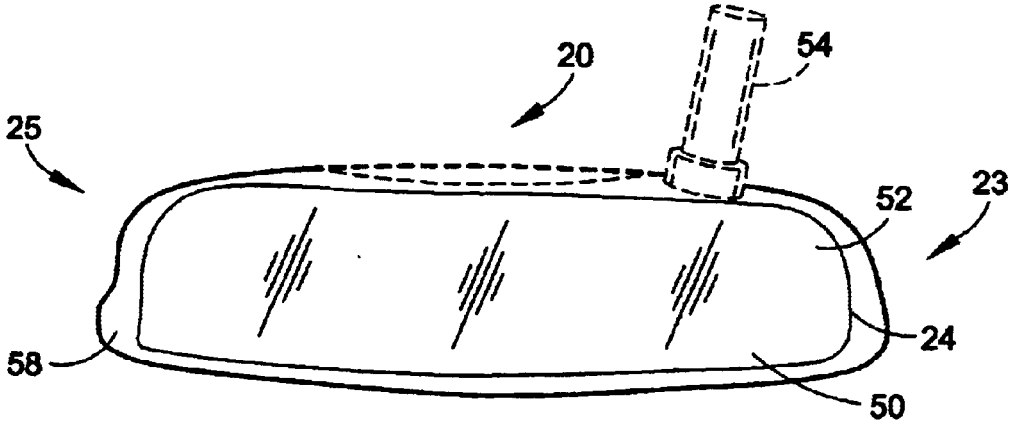
FIG. 13 is a front plan view of putter-type club head of FIG. 10.
Figure 14:
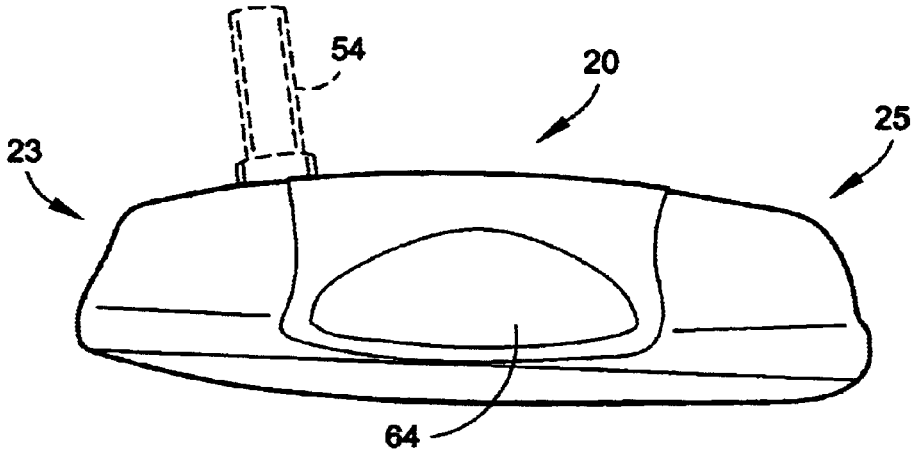
FIG. 14 is a rear plan view of putter-type club head of FIG. 10.
Figure 15:
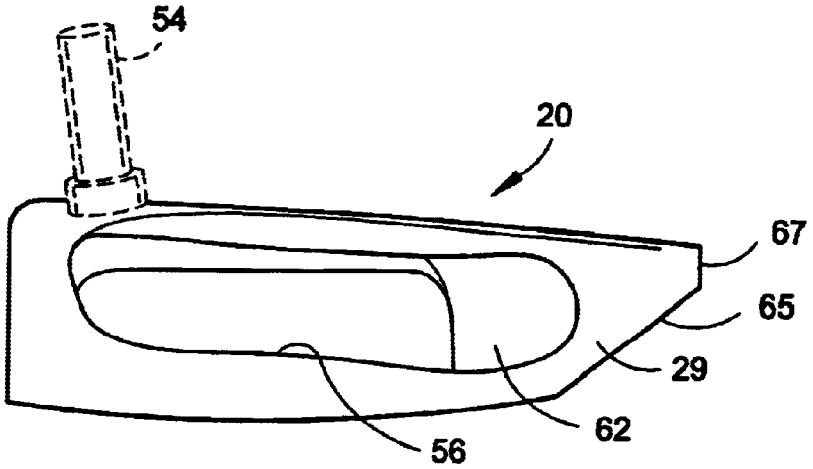
FIG. 15 is a heel side view of putter-type club head of FIG. 10.
Figure 16:
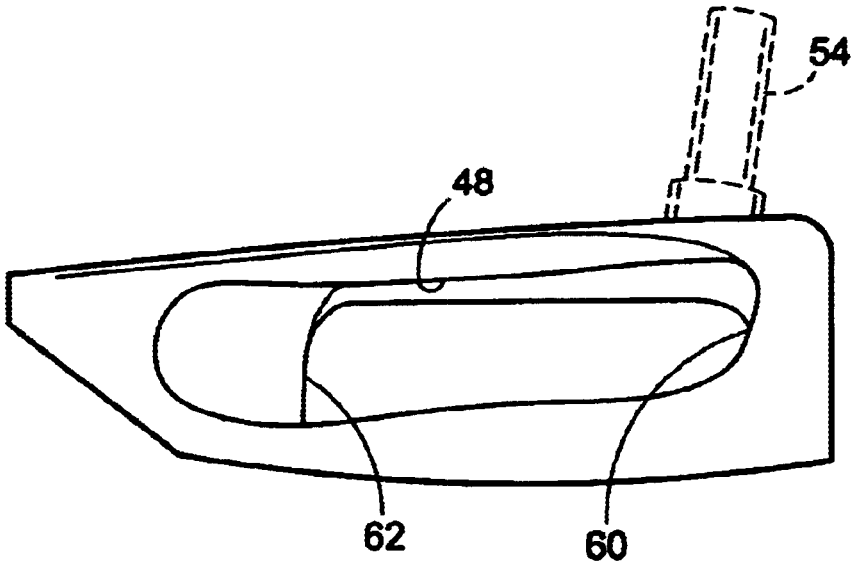
FIG. 16 is a toe side view of putter-type club head of FIG. 10.
Figure 17:
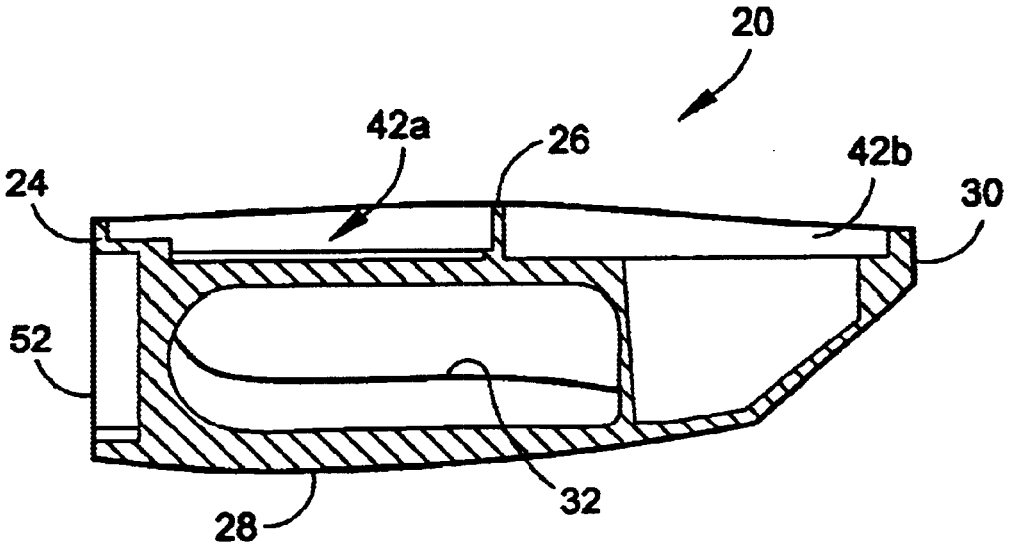
FIG. 17 is a cross-section view along line 17—17 of the putter-type club head of FIG. 10.

In an alternative sole embodiment shown in FIG. 12A, the sole portion 28 has a medial ridge 81 along the center of the sole portion 28 that is connected to an arc-heel ridge 83*a* and an arc-toe ridge 83*b* at a juncture 87. A front ridge 82 is perpendicular to the medial ridge 81 and is connected to the arc-heel ridge 83*a* at one end and the arc-toe ridge 83*b* at the other end of the front ridge 82. The medial ridge 81, the front ridge 82 and the arc-heel ridge 83*a* define a heel recess 85*a* having a surface 71*a*. The medial ridge 81, the front ridge 82 and the arc-toe ridge 83*b* define a toe recess 85*b* with a surface 71*b*. The medial ridge 81, the arc-heel ridge 83*a* and the toe-heel ridge 83*b* are preferably 0.125 inch above the surfaces 71*a* and 71*b* of the recesses 85*a* and 85*b*. This structure of the sole portion 28 moves mass to the perimeter of the body 22 and allows for greater stabilization of the putter-type club head 20 during a putt by a golfer.

The crown portion 26 extends rearward from the face portion 24. The crown portion 26 has a central elongated section 44 and a front section 46. The front section 46 has a width w' that extends from the heel end 23 to the toe end 25 of the face portion 24, and gradually narrows as the front section 46 transitions into the central elongated section 44. The width, w', preferably ranges from 2.5 inches to 4.5 inches, more preferably from 3.0 inches to 3.75 inches, and most preferably 3.5 inches. The central elongated section 44 has a width w" that is less than the width w' of the front section 46. The width, w", preferably ranges from 1.0 inch to 3.0 inches, more preferably from 1.5 inches to 2.25 inches, and most preferably 1.8 inches. The internal surface 48 of the crown portion 26 partially defines the central aperture 32. The crown portion preferably has a thickness that ranges from 0.10 inch to 0.50 inch, more preferably 0.15 inch to 0.30 inch.

The external surface 38 of the crown portion 26 preferably has an alignment means 40 thereon. The external surface 38 also preferably has a cylindrical rod 54 extending upward therefrom for engagement with a shaft, not shown. A preferred alignment means 40 is first and second inserts 40*a* and 40*b* disposed within first and second recesses 42*a* and 42*b* in the crown portion 26. The depth of each of the recesses 42*a* and 42*b* is preferably within 0.05 inch to 0.50 inch, more preferably 0.1 inch to 0.250 inch. Each of the circular inserts 40*a* and 40*b* preferably has a thickness ranging from 0.05 inch to 0.50 inch, more preferably 0.1 inch to 0.250 inch.

In a preferred embodiment, each of the circular inserts 40*a* and 40*b* is composed of a thermosetting polyurethane material such as described in U.S. Pat. No. 6,273,831, entitled Golf Club Head with A Polymer Insert, assigned to Callaway Golf (the assignee of the Present Application), which is hereby incorporated by reference in its entirety. Each of the circular inserts 40*a* and 40*b* is preferably colored white, through painting or doping of the polyurethane with coloring agents, and each circular insert 40*a* and 40*b* preferably has a texture of a golf ball cover. Each of the circular inserts 40*a* and 40*b* preferably has a diameter ranging from 1.62 inches to 1.70 inches, and most preferably 1.68 inches. Those skilled in the art will recognize that more than two circular inserts 40*a* and 40*b* may be utilized without departing from the scope and spirit of the present invention. Alternative alignment means are disclosed in U.S. Pat. No.

4,688,798, entitled Golf Club And Head Including Alignment Indicators, assigned to Callaway Golf (the assignee of the Present Application), which pertinent parts are hereby incorporated by reference. As disclosed in U.S. Pat. No. 4,688,798, the alignment means assists a golfer in properly aiming a golf ball toward a hole when putting. Alternative alignment means, including a large white strip may be utilized in the present invention.

The face portion 24 preferably has a thickness ranging from 0.10 inch to 0.50 inch, more preferably 0.20 inch to 0.35 inch. The face portion 24 has an internal surface 60 that partially defines the central aperture 32. The external surface 58 of the face preferably has a face recess 52 therein with a face insert 50 disposed therein such as disclosed in U.S. Pat. No. 6,238,302, entitled A Golf Club Head With An Insert Having Integral Tabs, assigned to Callaway Golf (the assignee of the Present Application), which is hereby incorporated by reference in its entirety. As disclosed in U.S. Pat. No. 6,238,302, the face insert is preferably composed of a thermosetting polyurethane material and is preferably colored white. In an alternative embodiment, the face portion 24 is a non-insert blade as is known in the art.

The body 22 preferably has a length, L, from the face portion 24 to the rearward most end of the aft mass portion 30 preferably ranging from 2.5 inches to 4.5 inches, more preferably from 3.0 inches to 3.5 inches, and most preferably 3.25 inches. In one alternative embodiment, the body 22 has a length, L, that is equal to the width, w'.

One aspect of the club head 20 is the concentration of mass in the center section 95 of the club head 20, as shown in FIG. 12. In a preferred embodiment, 210 grams to 250 grams of the mass of the club head 20 is located within the center section 95. In a most preferred embodiment, 232 grams of the mass of the club head 20 is located within the center section 95. Preferably 60% to 80% of the mass of the club head 20 is located within the center section 95.

As mentioned previously, the central aperture is defined by the internal surface 60 of the face portion 24, the internal surface 48 of the crown portion 26, the internal surface 56 of the sole portion 28 and the internal surface 62 of the aft-mass portion 30. The distance from the internal surface 48 of the crown portion 26 to the internal surface 56 of the sole portion 28 preferably ranges from 0.01 inch to 1.50 inches, more preferably 0.25 inch to 1.0 inch, and most preferably 0.5 inch. The distance from the internal surface 60 of the face portion 24 to the internal surface 62 of the aft-mass portion 30 preferably ranges from 1.0 inch to 3.50 inches, more preferably from 1.5 inches to 3.0 inches, and most preferably 1.87 inches. The body 22 is preferably formed as a single cast structure using known investment casting techniques. However, those skilled in the pertinent art will recognize that alternative forming techniques such as milling, welding forged or formed pieces, and the like may be utilized without departing from the scope and spirit of the present invention.

Figure 18:
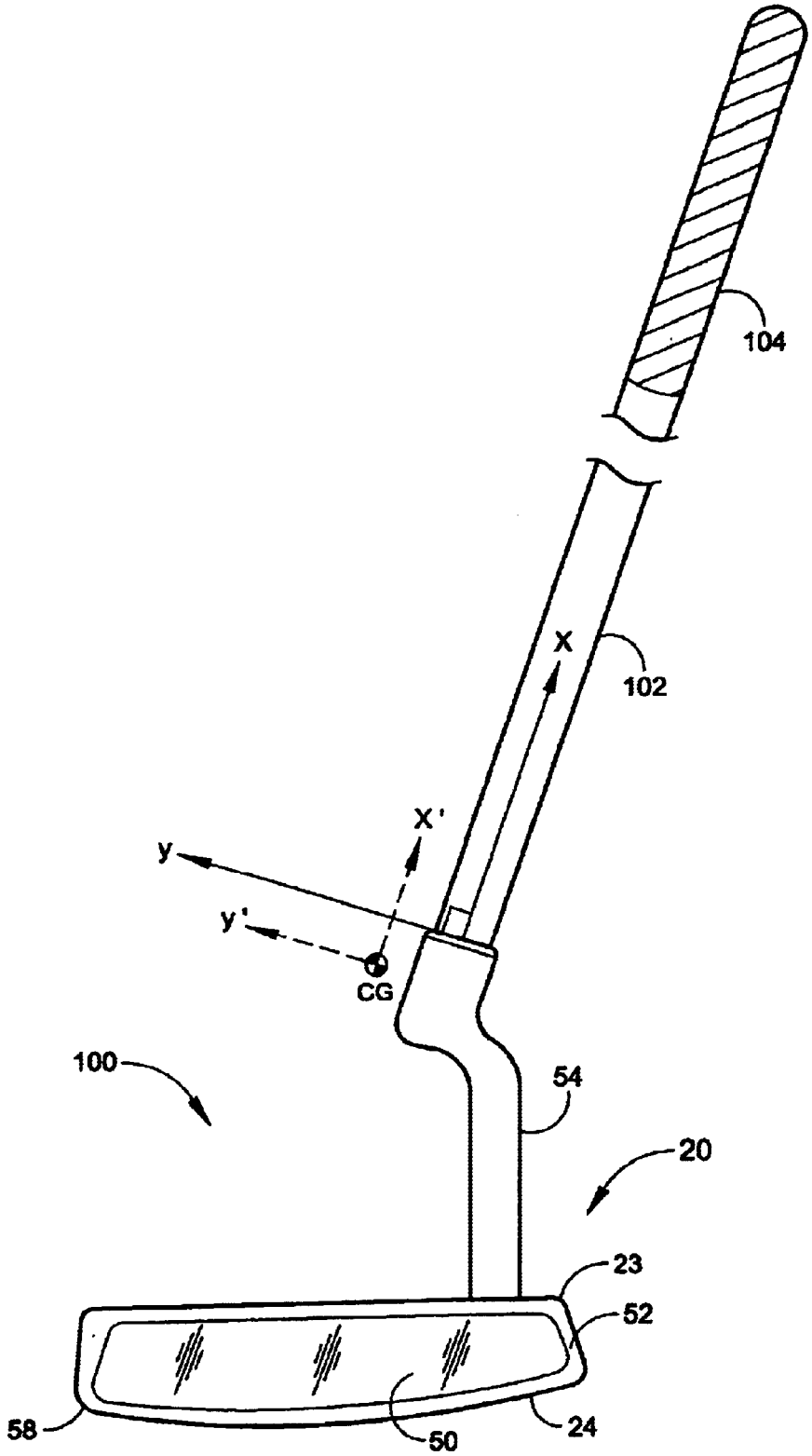
FIG. 18 is a front plan view of a putter.
Figure 19:
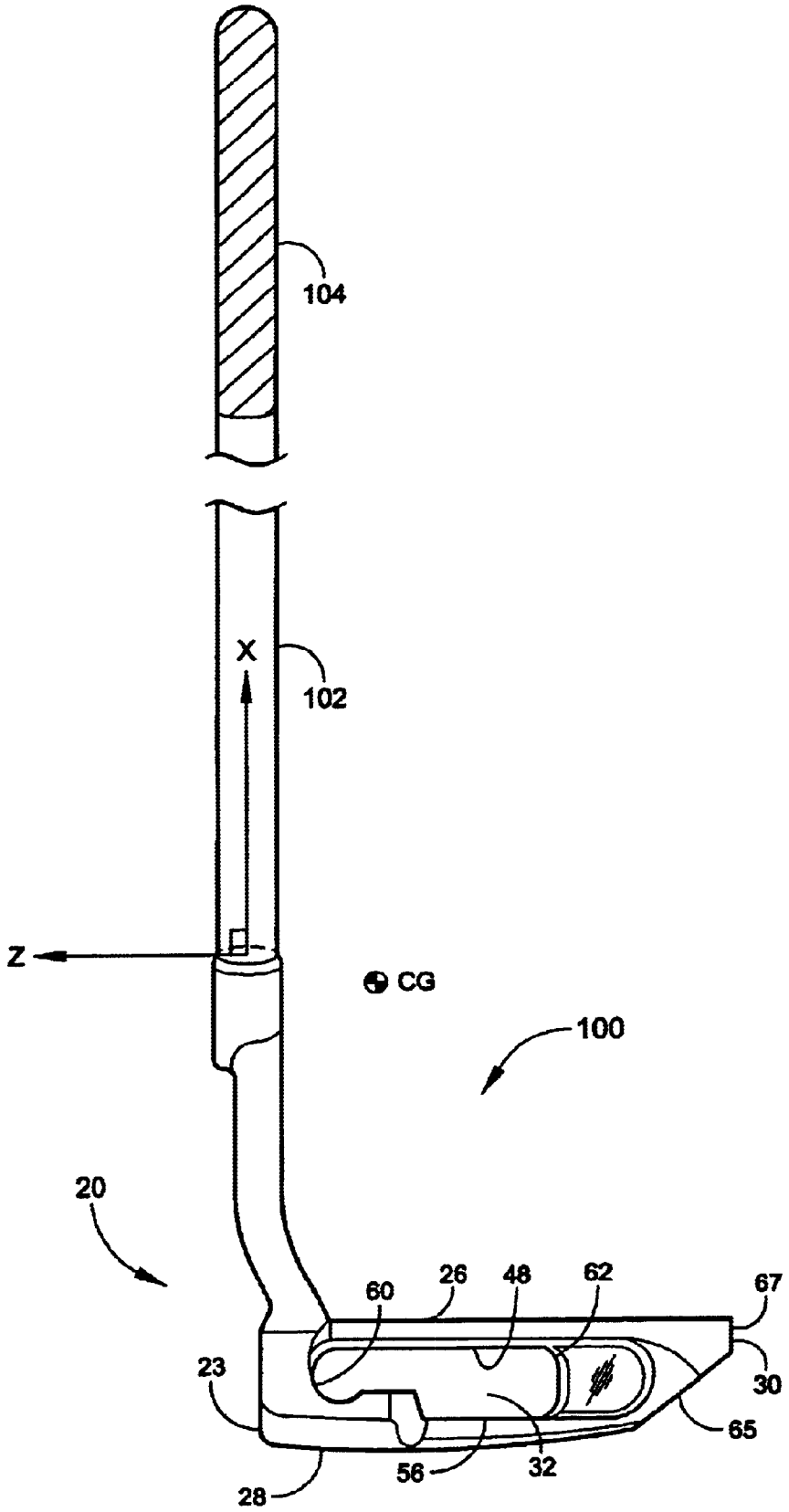
FIG. 19 is a side view of the putter of FIG. 18.
Figure 20:
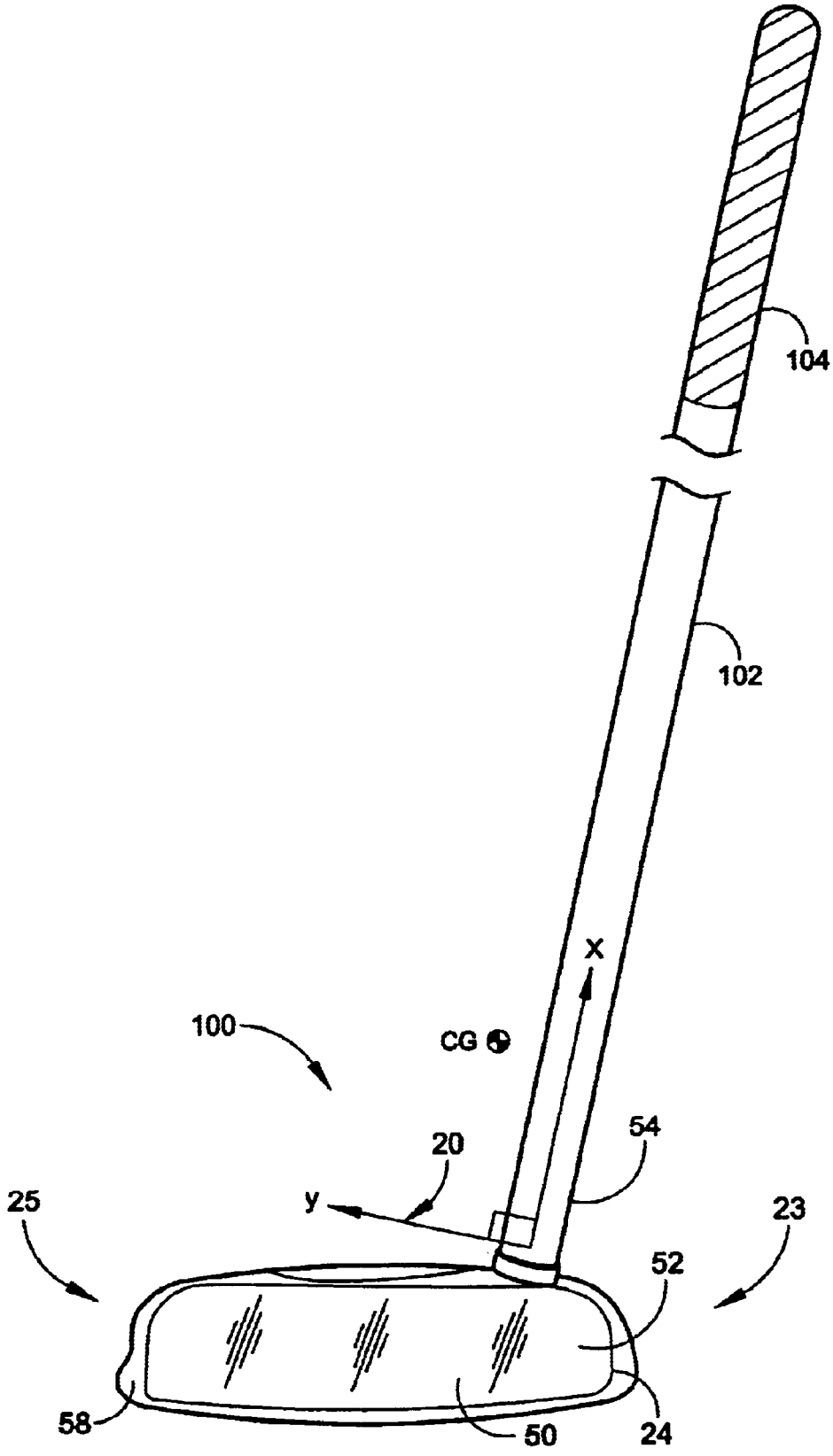
FIG. 20 is a front plan view of a putter.
Figure 21:
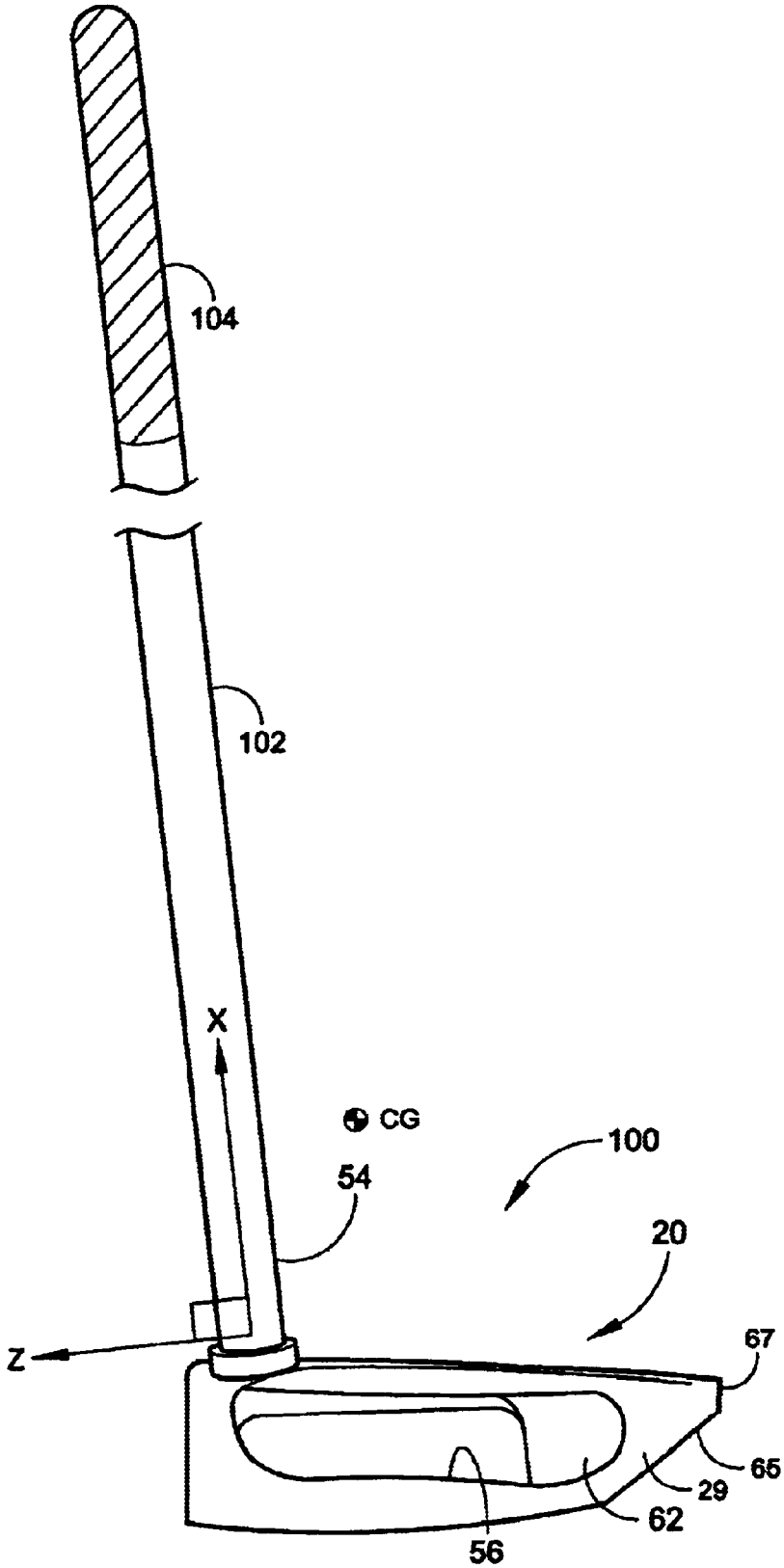
FIG. 21 is a side view of the putter of FIG. 20.

A preferred embodiment of a putter 100 is shown in FIGS. 18 and 19, and an alternative embodiment is shown in FIGS. 20–21. FIGS. 18–21 also illustrate a reference frame for measuring the center of gravity of the putter 100, which is different than the center of gravity for the club head 20. The putter 100 generally includes the putter club head 20, a shaft 102 and a grip 104. In one embodiment, the putter 100 has a conventional club length that preferably ranges from 33 inches to 36 inches, and a mass that preferably ranges from 475 grams to 525 grams.

In another embodiment, the putter 100 has a mid-club length that preferably ranges from 41 inches to 45 inches, and a mass that preferably ranges from 665 grams to 700 grams. In this mid-length embodiment, the shaft 102 preferably has a mss that ranges from 160 grams to 175 grams and the grip 104 preferably has a mass that ranges from 135 grams to 145 grams. The loft angle is preferably three degrees and the lie angle is preferably 72 degrees.

In yet another embodiment, the putter 100 has a long-club length that preferably ranges from 46 inches to 50 inches, and a mass that preferably ranges from 730 grams to 775 grams. In this long-length embodiment, the shaft 102 preferably has a mass that ranges from 160 grams to 175 grams. This long-length embodiment preferably has two grips 104 (the second grip not shown) with the top grip 104 preferably having a mass that ranges from 45 grams to 50 grams, and a bottom grip (not shown) having a mass that preferably ranges from 95 grams to 105 grams. The loft angle is preferably three degrees and the lie angle is preferably 78 degrees.

TABLE ONE

| Club Parameter Name | Units | 100 Pres. Inv. | White Hot #1 | White Hot #8 | Description |
|---|---|---|---|---|---|
| Total Mass | Grams | 497.8 | 496.8 | 501.3 | Total mass of club including head, shaft and grip |
| Length | Cm | 34 | 34 | 34 | Nominal length of club |
| Lie Angle | Degrees | 70 | 70 | 72 | |
| Xcg | Cm | −66.149 | −66.010 | −64.915 | Shaft Axis cg position |
| Ycg | Cm | 0.150 | 0.824 | 2.224 | CG offset normal to the swing plane |
| Zcg | Cm | −1.797 | −0.946 | −0.695 | Target Direction cg position |
| Sx | gm cm | — | — | — | Torsional Static Imbalance |
| Sy | gm cm | −894.5 | −470.0 | −348.4 | Swing Static Imbalance |
| Sz | gm cm | 11332.5 | 11600.8 | 11116.3 | Toe Down Static Imbalance |
| Ixx | Gm $cm^2$ | 4622 | 3499 | 4293 | Torsional Inertia |
| Iyy | Gm $cm^2$ | 456130 | 470200 | 462440 | Swing Inertia |
| Izz | Gm $cm^2$ | 454990 | 472810 | 465980 | Toe Down Inertia |
| Ixy | Gm $cm^2$ | 1975 | 9235 | 23639 | Torsion/Toe Down Inertia Coupling |

TABLE ONE-continued

| Club Parameter Name | Units | 100 Pres. Inv. | White Hot #1 | White Hot #8 | Description |
|---|---|---|---|---|---|
| Ixz | Gm $cm^2$ | −17065 | −9471 | −7275 | Torsion/Swing Inertia Coupling |
| Iyz | Gm $cm^2$ | 130 | 223 | 653 | Swing/Toe Down Inertia Coupling |

In Table One, a putter 100 (conventional length) of the present invention is compared to two different ODYSSEY®WHITE HOT® putters. Xcg, Ycg and Zcg reference the location of the center of gravity of the putters. The static imbalance is a measure of the distance (parallel to the ground) of the center of gravity of the putter 100 from the position of the golfer's hands on the grip 104 multiplied by the mass of the putter. One component of the static imbalance is the swing static imbalance Sy, which is the product of the putter mass and the offset distance of the center of gravity of the club head 20 behind the golfer's hands in the target direction. Swing static imbalance results in a torque at the hands that tends to swing the putter for a putter held motionless in the address position under the acceleration of gravity. The putter 100 has a much larger (almost twice as much) swing static imbalance, Sy, then conventional putters.

The location of the center of gravity of the putter 100 is measured using the reference frame through the straight portion of the shaft 102. The Xcg location is measured from the butt end of the shaft 102. As shown in FIGS. 18–21, the center of gravity of the putter 100 is located above the club head 20 and rearward from the face portion 24. As shown in Table One, the Zcg location of the putter 100 is much further rearward than the conventional putters, 1.797 cm for the putter 100 as compared to 0.946 cm and 0.695 cm for the conventional putters. It is believed that this rearward position of the center of gravity allows for the putter 100 to have a much larger absolute product of inertia, Ixz ( the torsion swing inertia) than the conventional putters, and a much smaller absolute product of inertia, Ixy (the torsion/toe down inertia) than the conventional putters. The torsion swing product of inertia couples angular accelerations about the shaft axis and the swing axis. As a result of this coupling a torque about a single axis will result in angular accelerations and velocities about both axes. Of, conversely, motion about two axes can be affected by a single torque. These club rotations in turn effect the putting of a golf ball. A more detailed discussion is found in Beer, F. P., Johnston, E. R. Jr., *Vector Mechanics for Engineers 5th Edition,* McGraw Hill, pp. 890–910, 1988, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A putter comprising:

a club head comprising a face portion, a sole portion extending rearward from the face portion, an aft mass portion rearward from the face portion a distance of between 2.5 inches to 4.5 inches, a crown portion extending rearward from the face portion, the crown portion having a central elongated section extending over the aft mass portion; and a shaft connected to the club head;

wherein the putter has a swing static imbalance, Sy, greater than 500 grams-centimeter, the swing static imbalance defined as the product of the putter mass and the-offset distance of the center of gravity of the club head behind the golfer's hands along the target direction.

2. The putter according to claim 1 wherein the putter has a torsion swing inertia, Ixz, that has an absolute value greater than 10,000 grams-centimeter square, wherein the torsion swing inertia is defined as the product of inertia of the angular acceleration about the shaft axis and the angular acceleration about the swing axis.

3. The putter according to claim 1 wherein the putter has a center of gravity located at least 1.5 centimeters rearward from a shaft axis of the putter.

4. The putter according to claim 1 wherein the club head has at least 70 percent of its mass located in a center section.

5. The putter according to claim 1 wherein the face portion has a recess with an insert disposed therein.

6. The putter according to claim 1 further comprising a grip attached to the shaft.

7. The putter according to claim 1 wherein the club head further comprises a cylindrical rod extending upward from an external surface of the crown portion for engagement with the shaft.

8. The putter according to claim 1 wherein the putter has a club length ranging from 46 inches to 50 inches.

9. The putter according to claim 8 wherein the putter has a mass ranging from 730 grams to 775 grams.

10. The putter according to claim 1 wherein the putter has a club length ranging from 41 inches to 45 inches.

11. The putter according to claim 10 wherein the putter has a mass ranging from 665 grams to 700 grams.

12. The putter according to claim 1 wherein the crown portion further comprises alignment means.

13. The putter according to claim 12 wherein the alignment means further comprises a plurality of circular inserts.

14. The putter according to claim 1 wherein the club head is composed of a material selected from the group consisting of titanium alloy, titanium, stainless steel, carbon steel and bronze.

15. A putter comprising:

a club head comprising a face portion, a sole portion extending rearward from the face portion, an aft mass portion rearward from the face portion a distance of between 2.5 inches to 4.5 inches, a crown portion extending rearward from the face portion, the crown portion having a central elongated section extending over the aft mass portion; and a shaft connected to the club head;

wherein the putter has a torsion swing inertia, Ixz, that has an absolute value greater than 10,000 grams-centimeter square, wherein the torsion swing inertia is defined as the product of inertia of the angular acceleration about the shaft axis and the angular acceleration about the swing axis.

16. The putter according to claim 15 wherein the putter has a center of gravity located at least 1.5 centimeters rearward from a shaft axis of the putter.

17. The putter according to claim 15 wherein the club head has at least 70 percent of its mass located in a center section.

18. The putter according to claim 15 wherein the face portion has a recess with an insert disposed therein.

19. The putter according to claim 15 further comprising a grip attached to the shaft.

20. The putter according to claim 15 wherein the club head further comprises a cylindrical rod extending upward from an external surface of the crown portion for engagement with the shaft.

21. The putter according to claim 15 wherein the putter has a club length ranging from 46 inches to 50 inches.

22. The putter according to claim 21 wherein the putter has a mass ranging from 730 grams to 775 grams.

23. The putter according to claim 15 wherein the putter has a club length ranging from 41 inches to 45 inches.

24. The putter according to claim 23 wherein the putter has a mass ranging from 665 grams to 700 grams.

25. The putter according to claim 15 wherein the crown portion further comprises alignment means.

26. The putter according to claim 25 wherein the alignment means further comprises a plurality of circular inserts.

27. The putter according to claim 15 wherein the club head is composed of a material selected from the group consisting of titanium alloy, titanium, stainless steel, carbon steel and bronze.

28. A putter comprising:

a club head comprising a face portion, a sole portion extending rearward from the face portion, an aft mass portion rearward from the face portion a distance of between 2.5 inches to 4.5 inches, a crown portion extending rearward from the face portion, the crown portion having a central elongated section extending over the aft mass portion; and a shaft connected to the club head;

wherein the club head has at least 70 percent of its mass located in a center section.

29. The putter according to claim 28 wherein the putter has a center of gravity located at least 1.5 centimeters rearward from a shaft axis of the putter.

30. The putter according to claim 28 wherein the face portion has a recess with an insert disposed therein.

31. The putter according to claim 28 further comprising a grip attached to the shaft.

32. The putter according to claim 28 wherein the club head further comprises a cylindrical rod extending upward from an external surface of the crown portion for engagement with the shaft.

33. The putter according to claim 28 wherein the putter has a club length ranging from 46 inches to 50 inches.

34. The putter according to claim 33 wherein the putter has a mass ranging from 730 grams to 775 grams.

35. The putter according to claim 28 wherein the putter has a club length ranging from 41 inches to 45 inches.

36. The putter according to claim 35 wherein the putter has a mass ranging from 665 grams to 700 grams.

37. The putter according to claim 28 wherein the crown portion further comprises alignment means.

38. The putter according to claim 37 wherein the alignment means further comprises a plurality of circular inserts.

39. The putter according to claim 28 wherein the club head is composed of a material selected from the group consisting of titanium alloy, titanium, stainless steel, carbon steel and bronze.

40. The putter according to claim 30 wherein the insert is composed of a polyurethane material.

* * * * *